US007442102B2

(12) United States Patent
Ito et al.

(10) Patent No.: US 7,442,102 B2
(45) Date of Patent: Oct. 28, 2008

(54) BOAT

(75) Inventors: Makoto Ito, Shizuoka-ken (JP); Takashi Yamada, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/617,508

(22) Filed: Dec. 28, 2006

(65) Prior Publication Data

US 2007/0178780 A1 Aug. 2, 2007

(30) Foreign Application Priority Data

Jan. 16, 2006 (JP) ..... 2006-006881

(51) Int. Cl.
*B60W 10/04* (2006.01)

(52) U.S. Cl. ..... 440/1; 440/86

(58) Field of Classification Search ..... 440/1, 440/86

See application file for complete search history.

(56) References Cited

U.S. PATENT DOCUMENTS

| | | | | |
|---|---|---|---|---|
| 2,466,282 A | | 4/1949 | Sparrow et al. | |
| 2,740,260 A | | 4/1956 | Blanchard | |
| 3,986,363 A | | 10/1976 | Beaman et al. | |
| 4,250,358 A | * | 2/1981 | Gilbertson | 200/52 R |
| 4,412,422 A | | 11/1983 | Rossi | |
| 4,622,938 A | | 11/1986 | Wenstadt et al. | |
| 4,646,696 A | | 3/1987 | Dogadko | |
| 4,648,497 A | | 3/1987 | Kawazoe | |
| 4,747,381 A | | 5/1988 | Baltz et al. | |
| 4,755,156 A | | 7/1988 | Wagner | |
| 4,788,955 A | | 12/1988 | Wood | |
| 4,805,396 A | | 2/1989 | Veerhusen et al. | |
| 4,809,506 A | | 3/1989 | Lauritsen | |
| 4,836,809 A | | 6/1989 | Pelligrino | |
| 4,858,585 A | | 8/1989 | Remmers | |

(Continued)

FOREIGN PATENT DOCUMENTS

JP 03-061196 3/1991

(Continued)

OTHER PUBLICATIONS

Product catalog of i6000TEC - Triple Engine Electronic Shift & throttle of Teleflex Morse Co., Ltd. (USA).

(Continued)

*Primary Examiner*—Stephen Avila
(74) *Attorney, Agent, or Firm*—Knobbe, Martens, Olson & Bear, LLP

(57) ABSTRACT

A remote control operation unit can have a remote control shift lever through which a boat operator can remotely control a forward drive mode, a neutral mode, and a reverse drive mode. A boat propulsion unit can have a shift switching device for shifting and a shift actuator for operating the shift switching device. A controller can be used to control the operation of the shift actuator in response to the operation amount of the remote control shift lever. The controller can also be configured to control the shift actuator such that in the case where the remote control shift lever has been shifted between a neutral position and a forward position or reverse position, when an engine is stopped and when shifting is not completed within a certain period of time, the shift actuator stops shifting operation.

19 Claims, 8 Drawing Sheets

U.S. PATENT DOCUMENTS

| | | | | |
|---|---|---|---|---|
| 4,861,295 | A * | 8/1989 | McElroy et al. | 440/86 |
| 4,898,045 | A | 2/1990 | Baba | |
| 4,964,276 | A | 10/1990 | Sturdy | |
| 5,004,962 | A | 4/1991 | Tonss et al. | |
| 5,062,403 | A | 11/1991 | Breckenfeld et al. | |
| 5,062,516 | A | 11/1991 | Prince | |
| 5,065,723 | A | 11/1991 | Broughton et al. | |
| 5,273,016 | A | 12/1993 | Gillespie et al. | |
| 5,318,466 | A | 6/1994 | Nagafusa | |
| 5,403,246 | A * | 4/1995 | Umemoto | 477/101 |
| 5,474,013 | A * | 12/1995 | Wittmaier | 114/286 |
| 5,492,493 | A | 2/1996 | Ohkita | |
| 5,539,294 | A | 7/1996 | Kobayashi | |
| 5,730,105 | A | 3/1998 | McGinnity | |
| 5,771,860 | A | 6/1998 | Bernardi | |
| 5,782,659 | A | 7/1998 | Motose | |
| 6,073,592 | A | 6/2000 | Brown et al. | |
| 6,098,591 | A | 8/2000 | Iwata | |
| 6,109,986 | A | 8/2000 | Gaynor et al. | |
| 6,233,943 | B1 | 5/2001 | Beacom et al. | |
| 6,273,771 | B1 | 8/2001 | Buckley et al. | |
| 6,280,269 | B1 | 8/2001 | Gaynor | |
| 6,587,765 | B1 | 7/2003 | Graham et al. | |
| 6,751,533 | B2 | 6/2004 | Graham et al. | |
| 6,965,817 | B2 | 11/2005 | Graham et al. | |
| 7,220,153 | B2 | 5/2007 | Okuyama | |
| 2005/0118895 | A1 | 6/2005 | Kanno et al. | |
| 2007/0082566 | A1 | 4/2007 | Okuyama | |
| 2007/0218785 | A1 | 9/2007 | Okuyama | |
| 2007/0227429 | A1 | 10/2007 | Okuyama | |

FOREIGN PATENT DOCUMENTS

| | | |
|---|---|---|
| JP | 2003-098044 | 4/2003 |
| JP | 2003-127986 | 5/2003 |
| JP | 2003-146293 | 5/2003 |
| JP | 2004-068704 | 3/2004 |
| JP | 2004-208452 | 7/2004 |
| JP | 2004-244003 | 9/2004 |
| JP | 2005-272352 | 9/2005 |
| JP | 2005-297785 | 10/2005 |
| JP | 2006-068575 | 3/2006 |
| JP | 2006-074794 | 3/2006 |
| JP | 2006-076871 | 3/2006 |
| JP | 2006-087325 | 4/2006 |
| JP | 2006-115305 | 4/2006 |
| JP | 2006-118039 | 5/2006 |
| JP | 2006-154480 | 6/2006 |
| JP | 2006-156526 | 6/2006 |

OTHER PUBLICATIONS

U.S. Appl. No. 11/731,691, filed Mar. 30, 2007, entitled Remote Control System for a Watercraft.
U.S. Appl. No. 11/731,057, filed Mar. 30, 2007, entitled Remote Control Unit for a Boat.
U.S. Appl. No. 11/731,422, filed Mar. 30, 2007, entitled Remote Control System for a Boat.
U.S. Appl. No. 11/731,086, filed Mar. 30, 2007, entitled Remote Control Device for a Boat.
U.S. Appl. No. 11/731,681, filed Mar. 30, 2007, entitled Remote Control Appratus for a Boat.
Co-pending U.S. Appl. No. 11/688,618; filed Mar. 20, 2007.
Co-pending U.S. Appl. No. 11/686,134; filed Mar. 14, 2007.
Barron, Jim. "Get on the Bus . . . " Trailer Boats Magazine, Jun. 2000, p. 36.
Spisak, Larry. "Know it by Chart. " Boating Magazin, May 2000, p. 100.
J.D. "Gains in technology will alter makeup of the . . . " Boating Industry International, Nov. 2000.
Declaration of Daniel J. Carr.
Denn, James. "Future boats sales will hinge on tachnology.." Boating Industry International, Nov. 2000.
Hemmel, Jeff. "Information, Please - The digital boating revolution begins." Boating Magazine, Sep. 2000.
Kelly, Chris. "Can We Talk?" Power & Motoryacht Magazine, Jun. 2000, pp. 36 & 38, 39.
"Plug and Play" Advertisement from "Motorboating", Dec. 2000, p. 57.
"MagicBus ™ i3000 Series Intelligent Steering" Instruction Manual. Telefex, Inc.

* cited by examiner

[FIG. 1]
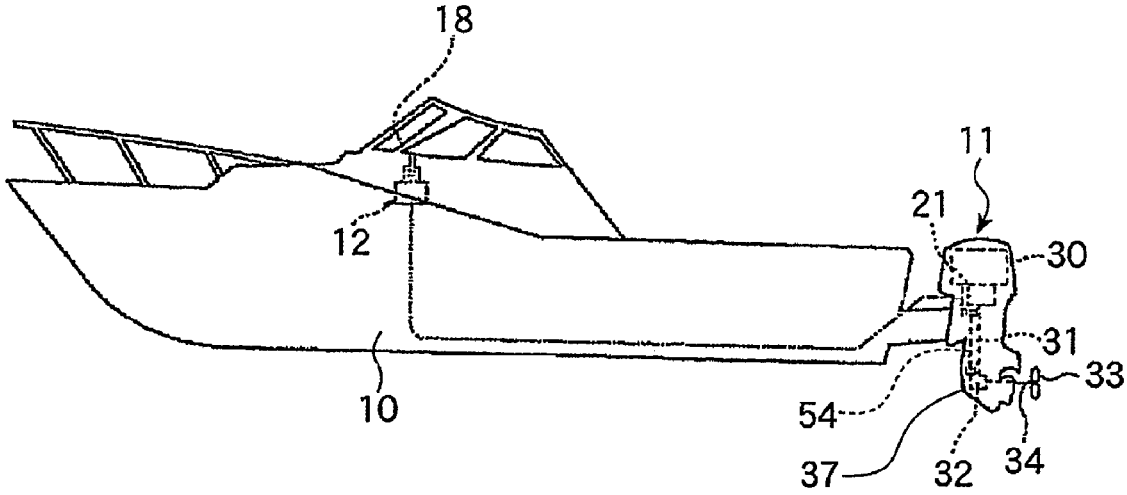

[FIG. 2]
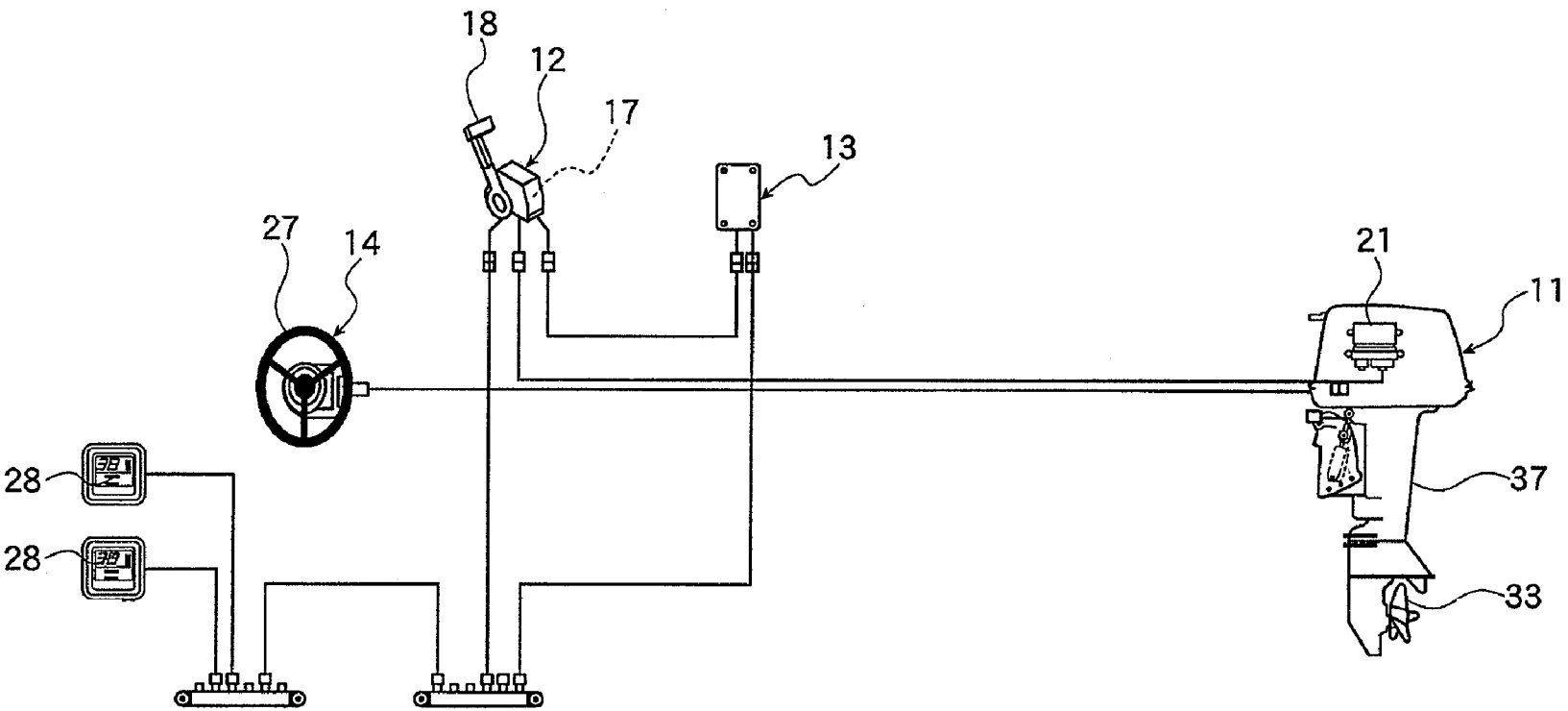

[FIG. 3]
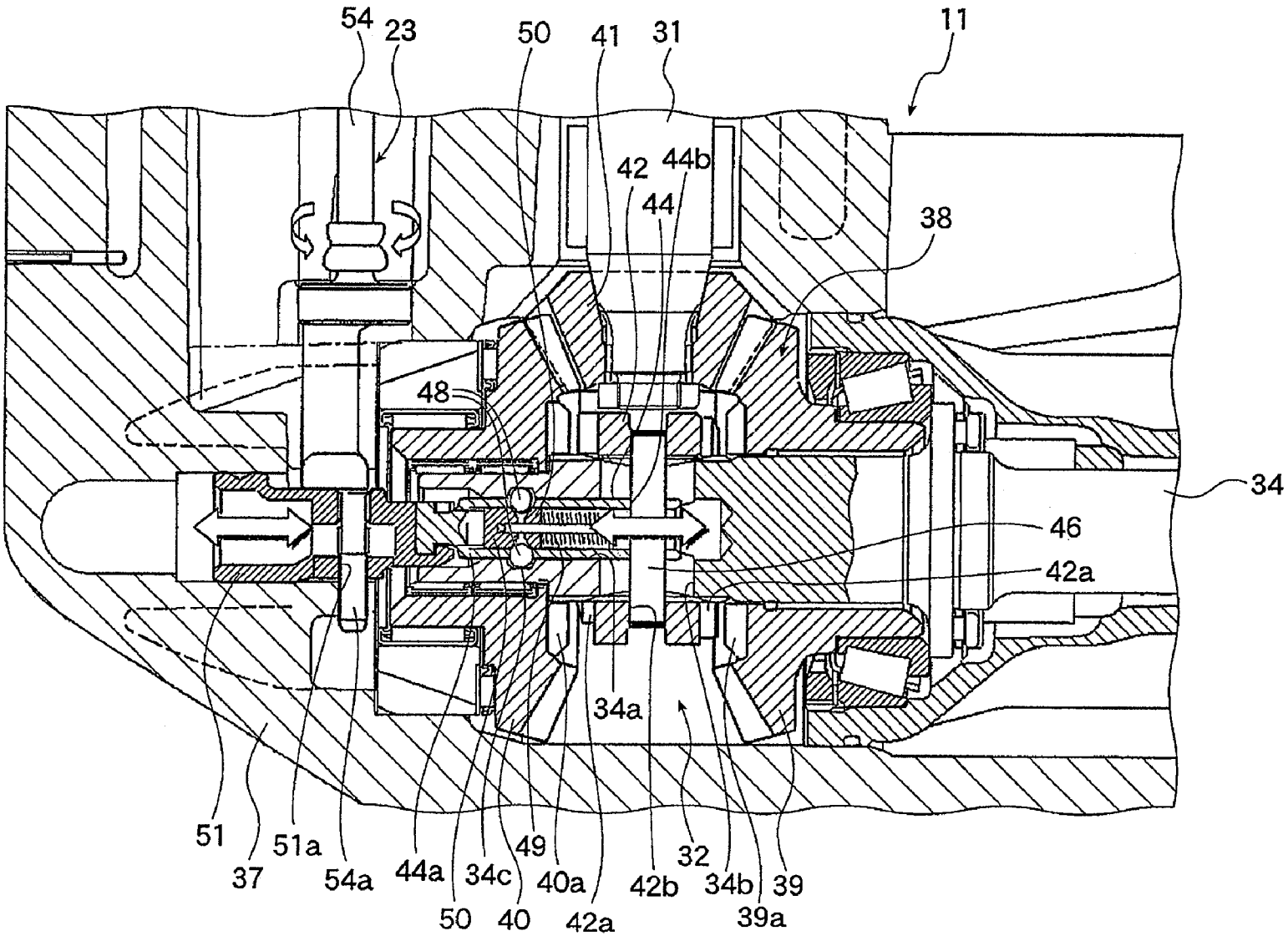

[FIG. 4]
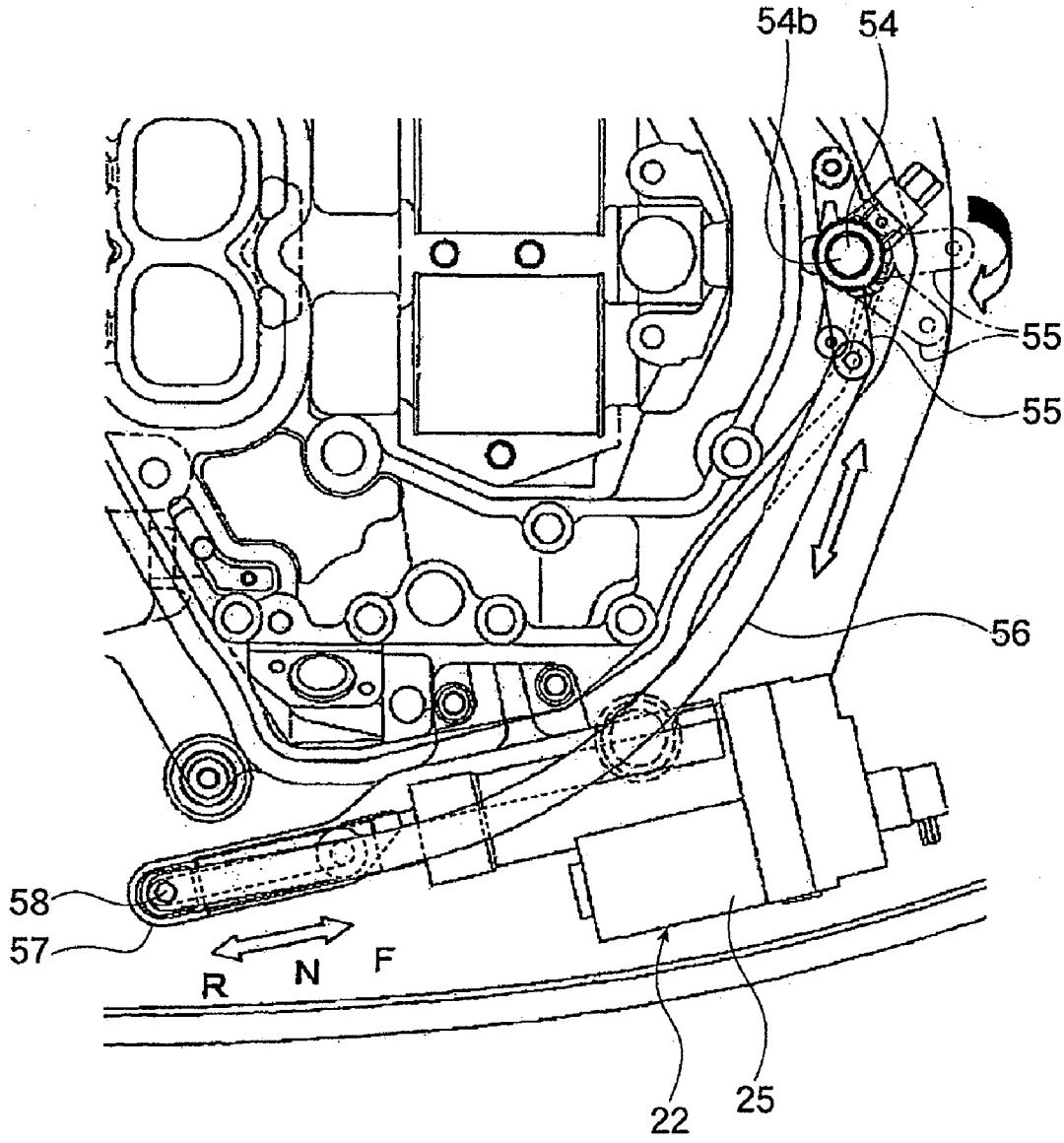

[FIG. 5]
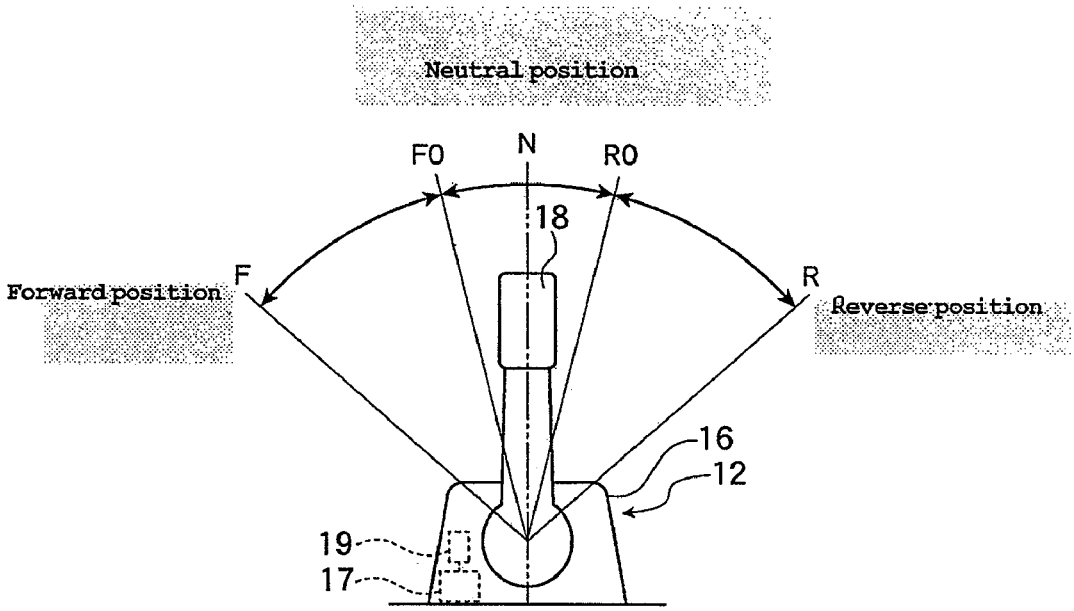

[FIG. 6]
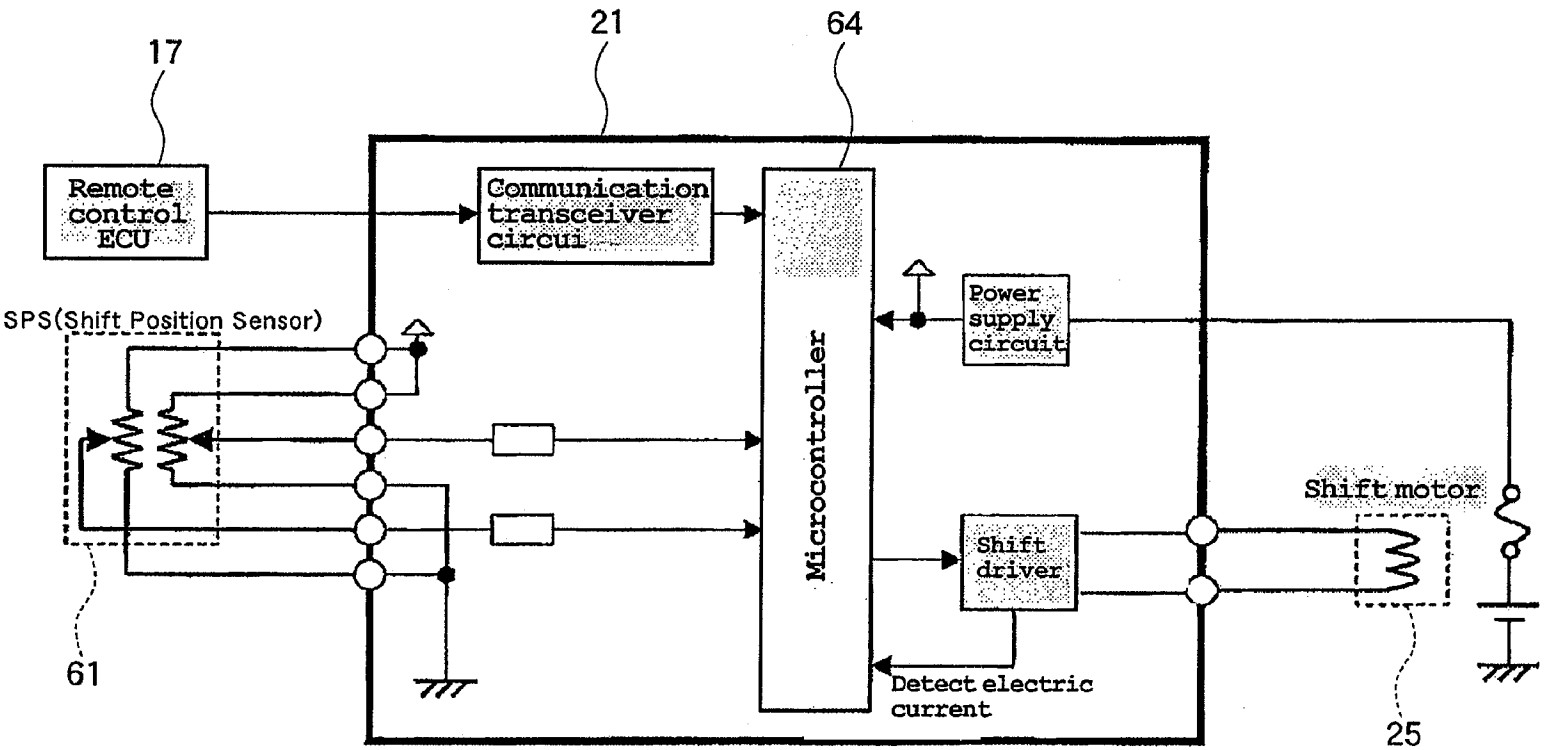

[FIG. 7]
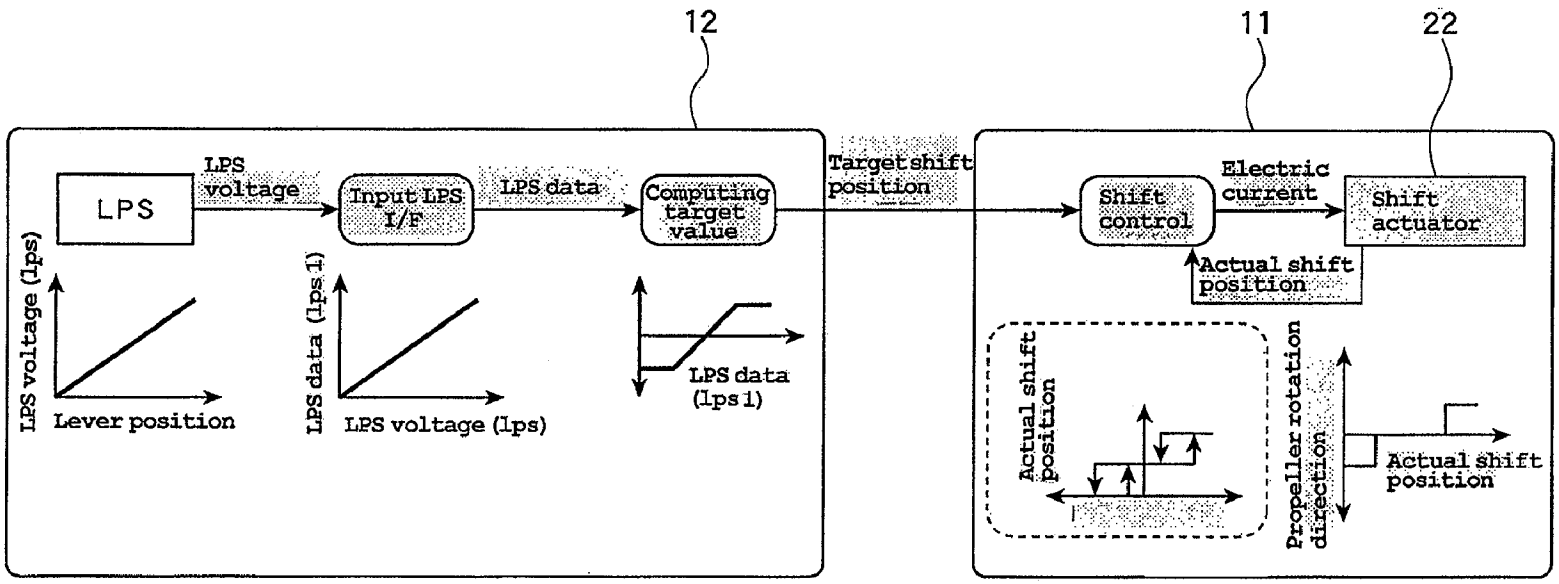

[FIG. 8]
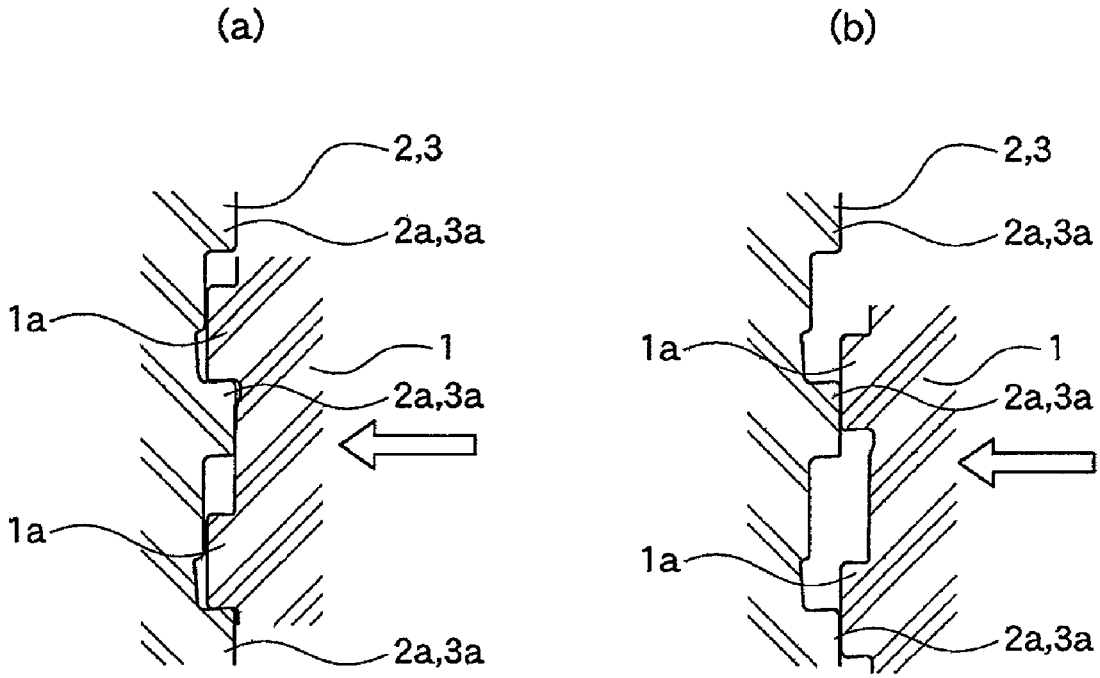

BOAT

PRIORITY INFORMATION

This application is based on and claims priority to Japanese Patent Application No. 2006-006881, filed Jan. 16, 2006, the entire contents of which is hereby expressly incorporated by reference.

BACKGROUND OF THE INVENTIONS

1. Field of the Inventions

The present inventions relate to boats having a remote control units, and more particularly, remote control units with shift levers through which a boat operator can remotely control forward, neutral, and reverse drive modes.

2. Description of the Related Art

Japanese Patent Document JP-A-2005-297785 discloses a shift system for a boat propulsion unit including a remote control operation unit having a remote control shift lever through which a boat operator can remotely shift the propulsion unit between forward, neutral, and reverse drive modes. The remote control operation unit also includes a boat propulsion unit having a shift switching device for selectively shifting between the forward, neutral, and the reverse drive modes and a shift actuator for operating the shift switching device. Control means are used for controlling the operation of the shift actuator in response to the operation amount of the remote control shift lever. The control means determines when the remote control shift lever has been operated within a certain range of a shift range from a neutral position, and then controls the operation amount of the actuator to the unit operation amount of the shift lever so as to vary with portions of the shift range.

Such conventional boats are configured such that the position of the remote control shift lever is first detected, then the shift actuator is controlled in response to the detected position of the remote control shift lever. For example, the shift switching device is operated by a driving force from the shift actuator. During operation, including when engine speed is relatively high, a dog clutch coupled to a propeller is in locking engagement with a forward or reverse gear.

SUMMARY OF THE INVENTION

An aspect of at least one of the embodiments disclosed herein includes the realization that when an operator of a boat with an electric transmission shifter attempts a "shift-in" (a shift from neutral to forward or reverse gears) or a "shift-out" (a shift from neutral to forward or reverse gears) while the engine is not running, the shift actuator motor can be overloaded.

For example, with reference to FIG. 8(*a*), in conventional boats, while the engine is stopped, shift-in will be successful when dogs 1*a* of a dog clutch 1 and dogs 2*a*, 3*a* of a forward gear 2 or a reverse gear 3 are in aligned relationship to each other as shown in FIG. 8(*a*). However, when those dogs 1*a*, 2*a*, 3*a* are misaligned as shown in FIG. 8(*b*), the dogs 1*a* and the dogs 2*a*, 3*a* will interfere with each other, resulting in unsuccessful shift-in. If shift operation is continued in the event of the unsuccessful shift-in, a shift motor, a linkage, a shift shaft, the dog clutch, the gears and the like can be overloaded. Such overloading can result in damage to those components.

Similarly, when a shift-out operation is performed with the engine stopped, a shift load, and thus a load on the actuator and other components might be large if rust, salt crystals or the like cause part of the shift linkage to stick.

Thus, in accordance with an embodiment, a boat can comprise a remote control operation unit comprising a remote control shift lever configured to allow a boat operator to remotely control a forward drive mode, a neutral mode, and a reverse drive mode of the boat. A boat propulsion unit can comprise a shift switching device configured to selectively shift between the forward drive mode, the neutral mode, and the reverse drive mode, and a shift actuator configured to operate the shift switching device. Additionally, a control means can be provided for controlling the operation of the shift actuator in response to the operation amount of the remote control shift lever, when the remote control shift lever has been operated within a predetermined range of a shift range. The control means can control the shift actuator such that in the case where the remote control shift lever has been shifted between a neutral position and a forward position or reverse position, when an engine is stopped and when shifting is not completed within a certain period of time, the shift actuator stops shifting operation.

In accordance with another embodiment, a boat can comprise a remote control operation unit comprising a remote control shift lever configured to allow a boat operator to remotely control a forward drive mode, a neutral mode, and a reverse drive mode of the boat. A boat propulsion unit can comprise a shift switching device configured to selectively shift between the forward drive mode, the neutral mode, and the reverse drive mode, and a shift actuator configured to operate the shift switching device. Additionally, a control means can be provided for controlling the operation of the shift actuator in response to the operation amount of the remote control shift lever, when the remote control shift lever has been operated within a predetermined range of a shift range. The control means can control the shift actuator such that in the case where the remote control shift lever has been shifted between a neutral position and a forward position or reverse position, when an engine is stopped and when shift speed is below a certain value after a lapse of a certain period of time from the start of shifting, the shift actuator stops shifting operation.

In accordance with a further embodiment, a boat can comprise a remote control operation unit comprising a remote control shift lever configured to allow a boat operator to remotely control a forward drive mode, a neutral mode, and a reverse drive mode of the boat. A boat propulsion unit can comprise a shift switching device configured to selectively shift between the forward drive mode, the neutral mode, and the reverse drive mode, and a shift actuator configured to operate the shift switching device. Additionally, a control means can be provided for controlling the operation of the shift actuator in response to the operation amount of the remote control shift lever, when the remote control shift lever has been operated within a predetermined range of a shift range. The control means can control the shift actuator such that in the case where the remote control shift lever has been shifted between a neutral position and a forward position or reverse position, when an engine is stopped and when the amount of electric current applied to the shift actuator is above a certain value for a certain period of time, the shift actuator stops shifting operation.

In accordance with a further embodiment, a boat can comprise a remote control operation unit comprising a remote control shift lever configured to allow a boat operator to remotely control a forward drive mode, a neutral mode, and a reverse drive mode of the boat. A boat propulsion unit can comprise a shift switching device configured to selectively shift between the forward drive mode, the neutral mode, and the reverse drive mode, and a shift actuator configured to operate the shift switching device. Additionally, a controller can be configured to control the operation of the shift actuator in response to the operation amount of the remote control shift lever, when the remote control shift lever has been operated within a predetermined range of a shift range. The controller can be configured to control the shift actuator to stop shifting operation when the remote control shift lever has been shifted between a neutral position and a forward position or reverse position, when an engine is stopped and at least one of (a) when shifting is not completed within a certain period of time, (b) when shift speed is below a certain value after a lapse of a certain period of time from the start of shifting, and (c) when the amount of electric current applied to the shift actuator is above a certain value for a certain period of time.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

FIG. 1 is a schematic side elevational view of a boat in accordance with an embodiment.

FIG. 2 is a block diagram illustrating the connection between a remote control operation unit, a key switch unit, an outboard motor and the like that can be used with the boat of FIG. 1.

FIG. 3 is a sectional view of a shift device that can be used with the boat of FIG. 1.

FIG. 4 is an enlarged plan view of a shift actuator and the like that can be sued with the boat of FIG. 1.

FIG. 5 is a schematic side elevational view of a remote control shift lever that can be used with the boat of FIG. 1.

FIG. 6 is a block diagram illustrating a remote control ECU, an engine ECU and the like that can be sue with the boat of FIG. 1.

FIG. 7 illustrates a control flow that can be used to control an operation of the boat in FIG. 1.

FIGS. 8(*a*) and 8(*b*) are enlarged schematic sectional views of an engagement part between a dog clutch and a gear.

DETAILED DESCRIPTION OF THE PREFERRED EMBODIMENT

Improved boats and remote control systems for boats are disclosed herein. Although the present boats and remote control systems are illustrated and described in the context of an outboard motor-powered boat, the present inventions can be used with other types of remote control systems and other types of vehicles.

As shown in FIGS. 1 and 2, the boat can include a hull 10 with an outboard motor 11 which can serve as a "boat propulsion unit" mounted to the stern of the hull 10 However, other types of systems can serve as the propulsion unit.

With reference to FIG. 1, on the operator's side of the hull 10, there can be provided a remote control operation unit 12, a key switch unit 13, a steering wheel unit 14 and the like, through which the outboard motor 11 can be controlled to operate the boat. However, other arrangements and configurations can also be used.

With reference to FIG. 5, The remote control operation unit 12 can have a remote control ECU 17 included in a remote control body 16, and can also be provided with a remote control shift lever 18 through which a boat operator can perform throttle and shift operations. Operating the remote control shift lever 18 permits remote shifting between forward, neutral, and reverse drive modes.

With continued reference to FIG. 5, a central position where the remote control shift lever 18 is held in a generally vertical direction can be defined as a neutral position (N). In some applications where the body 12 is mounted to an inclined surface, the lever 18 might be at a non-vertical orientation in the neutral position. In such applications, the lever 18 might be generally perpendicular relative to the surface to which the body 12 is mounted. However, other orientations can also be used as the neutral position.

A position where the remote control shift lever 18 is held forward at a predetermined angle relative to the neutral position can be defined as a forward position (F). Additionally, a position where the remote control shift lever 18 is held rearward at a predetermined angle relative to the neutral position can be defined as a reverse position (R). Information on the operation speed of the remote control shift lever 18 and the angle to which the remote control shift lever 18 has been set, can be to be detected by a potentiometer 19 and then transmitted to the remote control ECU 17.

As shown in FIG. 6, a signal output from the remote control ECU 17 can be transmitted to an engine ECU 21 of the outboard motor 11. The engine ECU 21 can be configured to control the operation of a shift motor 25 of a shift actuator 22 (FIG. 4) in response to the information on the operation amount of the remote control shift lever 18. The shift actuator 22 can be configured to actuate a shift switching device 23 (FIG. 3) to shift between the forward, neutral, and the reverse drive modes.

As shown in FIG. 2, the remote control ECU 17 of the remote control operation unit 12 can be connected to the key switch unit 13 described above. The key switch unit 13 can include a start switch and a main/stop switch, which are not shown in the figure. Other configurations can also be used.

The steering wheel unit 14 can include a steering wheel ECU (not shown) therein, and can also be provided with a steering wheel 27 through which the boat operator can perform steering operations. The position of the steering wheel can be detected by a position sensor, which can be connected to the steering wheel ECU via a signal circuit.

The steering wheel ECU of the steering wheel unit 14 can be connected to the engine ECU 21 of the remote control operation unit 12 via a DBWCAN cable as a signal line. Here, the term "DBW" is an abbreviation for "Drive-By-Wire", and refers to a manipulation device through electrical connection instead of mechanical connection. Also, the term "CAN" is an abbreviation for "Controller Area Network". However, other types of networks and communication techniques can also be used. Gauges 28 can also be connected to the remote control operation unit 12 and/or other devices.

The outboard motor 11 can also include an engine 30 disposed in an upper portion thereof. The engine 30 can be adapted such that the output of the engine 30 is transmitted to a propeller shaft 34 with a propeller 33 secured thereto, via a drive shaft 31 and a shift device 32. However, other configurations can also be used.

Shifting the shift device 32 between the forward, neutral, and the reverse drive modes can be performed by the shift switching device 23, which is configured to be operated by the shift actuator 22 described above.

For example, as shown in FIGS. 1 to 3, the outboard motor 11 can have a propeller 33 mounted to the propeller shaft 34 that is disposed in a space defined by a casing 37 and extends substantially horizontally. The propeller shaft 34 can be coupled to the drive shaft 31 via a forward/reverse drive switching or "shifting" gear mechanism 38.

The gear mechanism 38 can include a forward gear 39 and a reverse gear 40, both of which can be rotatably mounted on the propeller shaft 34. The drive shaft 31 can be configured to be driven clockwise (as viewed from above), and can have a pinion 41 secured thereto. The gears 39 and 40 are configured for meshing engagement with the pinion 41 and are adapted for rotation in opposite directions relative to each other. However other configurations can also be used.

The forward gear 39 can be disposed rearwardly (the forward direction of the boat being leftward in FIG. 3), and the reverse gear 40 can be disposed forwardly.

A sleeve-like dog clutch 42 can be located between the gears 39 and 40 and can be in spline engagement with the periphery of the propeller shaft 34. The dog clutch 42 can be made slidable in the axial direction of the propeller shaft 34. The dog clutch 42 can have dogs 42*a* projecting from opposite sides thereof in the axial direction. The gears 39 and 40 respectively have dogs 39*a* and 40*a* which can be in opposed relation to the corresponding dogs 42*a* so as to form a "dog clutch".

The propeller shaft 34 can have a forward end having an insertion hole 34*a* that extends in the axial direction and can be open at its front end. A shift sleeve 44 can be received in the insertion hole 34*a* in a manner so as to be slidable in the axial direction. The sidewall of the insertion hole 34*a* of the propeller shaft 34 has an axially extending slot 34*b*. However other configurations can also be used.

The shift sleeve 44 and the dog clutch 42 respectively can have through holes 44*b* and 42*b* extending across the diameters thereof. A pin 46 can be received in the through hole 42*b* of the dog clutch 42, the slot 34*b* of the propeller shaft 34, and the through hole 44*b* of the shift sleeve 44.

In this structure, the movement of the shift sleeve 44 causes the pin 46 to move in the axial direction within the slot 34*b*, causing the dog clutch 42 to move in the axial direction of the propeller shaft 34 via the pin 46.

The shift sleeve 44 can have detent balls 48 disposed thereon in a manner to come into and out of the peripheral face thereof to disengagement from and engagement with recesses 34*c* of the propeller shaft 34. The detent balls 48 are normally urged outwardly by a spring 49 and a pressing member 50.

The forward end 44*a* of the shift sleeve 44 can be coupled to a shifter 51 that can be made slidable in the lateral direction in FIG. 3. The shifter 51 has an engagement groove 51*a* extending in a vertical direction.

A shift shaft 54 of the shift switching device 23 has a lower end with a cranked portion that can be disposed eccentrically from the axis of rotation of the shift shaft 54. The cranked portion has an actuation pin 54*a*, which can be received in the engagement groove 51*a*. As the shift shaft 54 is rotated, the actuation pin 54*a* eccentrically rotates, causing the shifter 51 to slide in a manner to slide the dog clutch 42.

Rotation of the shift shaft 54 in one direction causes the dog clutch 42 to slide in the one direction, while rotation of the shift shaft 54 in the other direction causes the dog clutch 42 to slide in the other direction. However other configurations can also be used.

The shift shaft 54 extends in the vertical direction, and as shown in FIG. 4 (plan view), the upper end 54*b* of the shift shaft 54 can be secured to a lever 55. The lever 55 has a distal end coupled to a pivotal end of a lever shift rod 56. The other end of the lever shift rod 56 can be pivotally coupled to a slider 58 that can be configured to be slidable along a shift rail 57. As the shift actuator 22 slides the slider 58, the shift shaft 54 is rotated via the lever shift rod 56 and the lever 55.

The shift actuator 22 can include the shift motor 25 that can be a DC motor, a speed reducer and the like, and serves to operate the slider 58 in predetermined directions. As such, the shift motor 25 serves as a drive source.

As shown in FIG. 6, the shift actuator 22 can be provided with a shift position sensor 61, which can be configured to detect shift positions (forward, neutral, and reverse positions) of the shift actuator. A signal output from the shift position sensor 61 can be input to a microcontroller 64 of the engine ECU 21.

The microcontroller 64, which can serve as a "control means", can be configured to control the operation of the shift actuator 22 to conduct shifting operations as well as other operations. Additionally, in some embodiments, the microcontroller 64 can be configured to stop a shifting operation if the remote control shift lever 18 has been shifted between the neutral position and the forward position or reverse position, for example, if the remote control shift lever 18 has been shifted from the neutral position to the forward position or the reverse position, when the engine is stopped and when shifting is not completed within a certain period of time.

In some embodiments, the microcontroller 64 can be configured to determine whether or not the remote control shift lever 18 has been shifted from the neutral position to the forward position or the reverse position and whether or not a certain or "predetermined" period of time has elapsed after the start of shifting, based on a signal from the shift position sensor 61. The predetermined time can be any length of time. For example, the predetermined time can be adjusted, or it can be varied in accordance with a predetermined schedule, map, or equation, or based on one or more parameters.

The microcontroller 64 can also be configured to determine whether or not the engine 30 is stopped based on a signal from an engine speed sensor (not shown). As described above, in the case where the remote control shift lever 18 has been shifted from the neutral position to the forward position or the reverse position, when the engine is stopped and when shift-in is not completed within a certain period of time, the microcontroller controls the shift actuator 22 such that the shift actuator stops the shifting operation and returns to the neutral position.

In operation, for example, during the replacement of the propeller 33 or another operation, with the engine 30 stopped, a worker might set the shift device 32 to a shift-in state so as to facilitate the replacement of the propeller 33. The shift-in state connects the propeller shaft 34 with the stopped drive shaft 31, and thus prevents the propeller from rotating.

In this case, the worker pivots the remote control shift lever 18 of the remote control operation unit 12 from the neutral position to the forward position or the reverse position. At this time, the position of the remote control shift lever 18 is detected by the potentiometer 19 and then input to the remote control ECU 17 and converted to a lever position voltage (LPS voltage) as shown in FIG. 7.

The lever position voltage is input to an interface (I/F) and then converted to lever position data. The lever position data (LPS data) is used to compute a target value, converted to a target shift position signal, and then input to the microcontroller 64 of the engine ECU 21 for shift control. In response to the shift control by the microcontroller 64, a certain amount of electric current is applied to the shift actuator 22 so that the shift motor 25 of the shift actuator 22 is operated in a certain direction at a certain speed.

An actual shift position of the shift actuator 22 can be detected by the shift position sensor 61 and then fed back to the microcontroller 64 to effect a shift control to achieve a desired position of the shift actuator 22.

As the shift motor 25 of the shift actuator 22 is operated, the dog clutch 42 is made to slide in a certain direction via the slider 58, the lever shift rod 56, the shift shaft 54, the shifter 51, the shift sleeve 44, the pin 46 and the like. As such, the dog 42*a* of the dog clutch 42 is brought into engagement with the dog 39*a* of the forward gear 39 or the dog 40*a* of the reverse gear 40 to thereby achieve shift-in.

In this case the engine 30 is stopped, so that the forward gear 39 and the reverse gear 40 are stopped. Thus, when the dog clutch 42 and the forward gear 39 or reverse gear 40 are misaligned with each other, the dog 42*a* of the dog clutch 42 does not engage with the dog 39*a* of the forward gear 39 or the dog 40*a* of the reverse gear 40.

In this case, when the microcontroller 64 has determined the incompletion of the shift-in within a certain period of time based on a signal from the shift position sensor 61, the shift actuator 22 is controlled to stop the shifting operation and return to the neutral position.

In some embodiments, in response to the incompletion, a signal from the microcontroller 64 can be used to trigger an alarm from an alarm device (not shown) so that the worker can be advised of the stop of the shifting operation and the return to the neutral gear position. The alarm can be embodied in any forms such as an audible alarm, a visual alarm such as a flashing lamp, or any other device for notifying one in the vicinity of the outboard motor 11.

When the worker sets the target shift position of the remote control shift lever 18 back to the neutral position accordingly, the operation of the remote control shift lever is detected by the potentiometer 19, which transmits a signal to the microcontroller 64 so as to return the shift actuator to a normal operating state. This causes the propeller shaft 34 to slightly rotate, permitting the worker to perform shift-in operation again.

In such structure, in the case where the remote control shift lever 18 has been shifted from the neutral position to the forward position or the reverse position, when the engine is stopped and when shifting is not completed within a certain period of time, the shift actuator is controlled to stop the shifting operation. This makes it possible to avoid overloading the shift motor 25 and other mechanical parts due to unnecessary continuation of the shift operation, and to reduce unnecessary battery power consumption.

Further, when the target shift position has been set back to the neutral position through the worker's operation of the remote control shift lever 18, the shift actuator 22 can be controlled to return to the normal operating state. This makes it possible to return the shift device 32 to an operable state again through the operation by the worker even when the shift-in operation has been stopped.

Additionally, in some embodiments, an alarm can be issued after the shifting operation is stopped. The worker can thereby notice the unsuccessful shifting easily and take proper measures.

In the above arrangements, in the case where the remote control shift lever 18 has been shifted from the neutral position to the forward position or the reverse position, when the engine 30 is stopped and when the shift-in is not completed within a certain period of time, the shift actuator 22 is controlled to stop the shift-in operation. In the arrangement noted below, in the case where the remote control shift lever 18 has been shifted out from the forward position or the reverse position to the neutral position, when the engine 30 is stopped and when the shift-out is not completed within a certain period of time, the shift actuator 22 is controlled to stop the shift-out operation.

In such structure, it is also possible to avoid overloading the shift motor 25 and other mechanical parts due to unnecessary continuation of the shift operation, even when the engine 30 is stopped and shift-out is impossible due to an obstacle near a shift link. Like the arrangements described above, the arrangements described below can also employ an alarm system.

It is also understood that while in the arrangements described above, the shift actuator 22 is controlled to stop the shifting operation when the engine 30 is stopped and when shifting is not completed within a certain period of time. However, the inventions disclosed herein are not limited to such a configuration. Rather, the embodiments disclosed herein may be adapted such that the shift actuator 22 is controlled to stop the shifting operation when the engine 30 is stopped and when shift speed is below a certain value after a lapse of a certain period of time from the start of shifting.

For example, in the case where the remote control shift lever 18 has been shifted between the neutral position and the forward position or reverse position, when the engine 30 is stopped and when shift speed is below a certain value after a lapse of a certain period of time from the start of shifting, the shift actuator 22 can be controlled to stop the shifting operation considering that the low shift speed might be caused by a seizure or the like of actuation parts. It is thus possible to avoid overloading the shift motor 25 and other mechanical parts due to unnecessary continuation of the shift operation.

Additionally, while in the arrangements described above, the shift actuator 22 can be controlled to stop the shifting operation when the engine 30 is stopped and when shifting is not completed within a certain period of time, the present inventions are not limited such a configuration. Rather the present embodiments can be adapted such that the shift actuator 22 is controlled to stop the shifting operation when the engine 30 is stopped and when the amount of electric current applied to the shift actuator 22 is above a certain value for a certain period of time.

In such a configuration where the remote control shift lever 18 has been shifted between the neutral position and the forward position or reverse position, when the engine 30 is stopped and when the amount of electric current applied to the shift actuator 22 is above a certain value for a certain period of time, the shift actuator 22 is controlled to stop the shifting operation considering that the shift actuator 22 might be subjected to an excessive force. It is thus possible to avoid overloading the shift motor 25 and other mechanical parts due to unnecessary continuation of the shift operation.

Further, a shifting force produced when the engine 30 is stopped can be smaller than when the engine 30 is in operation. In this case, it is possible to reduce battery power consumption further and to avoid excessive forces applied to the shift motor 25 and other mechanical parts further. It should be noted that while the engine 30 is stopped, the dog 39*a*, 40*a* of the gear 39, 40 can be brought into engagement with the dog 42*a* of the dog clutch 42 even by a small shifting force, when they are in aligned relationship to each other. On the other hand, when they are misaligned, they cannot engage with each other even by a large shifting force. It is thus understood that a smaller shifting force is more advantageous.

It is also understood that while in the foregoing embodiments, the outboard motor 11 is employed as the "boat propulsion unit," it may be replaced by an inboard-outdrive engine or the like.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A boat comprising:

a remote control operation unit comprising a remote control shift lever configured to allow a boat operator to remotely control a forward drive mode, a neutral mode, and a reverse drive mode of the boat;

a boat propulsion unit comprising a shift switching device configured to selectively shift between the forward drive mode, the neutral mode, and the reverse drive mode, and a shift actuator configured to operate the shift switching device; and a control means for controlling the operation of the shift actuator in response to the operation amount of the remote control shift lever, when the remote control shift lever has been operated within a predetermined range of a shift range;

wherein the control means controls the shift actuator such that in the case where the remote control shift lever has been shifted between a neutral position and a forward position or reverse position, when an engine is stopped and when shifting is not completed within a certain period of time, the shift actuator stops shifting operation.

2. The boat according to claim 1 additionally comprising an alarm configured to be triggered when the control means stops the shifting operation.

3. The boat according to claim 1, wherein the control means controls the shift actuator to return to the neutral position after the stop of the shifting operation.

4. The boat according to claim 1, wherein the control means controls the shift actuator to return to a normal operating state when a target shift position has been set back to the neutral position through the operation of the shift lever after the stop of the shifting operation.

5. The boat according to claim 1, wherein the shifting is shift-out of the remote control shift lever from the forward position or the reverse position to the neutral position.

6. A boat comprising:

a remote control operation unit comprising a remote control shift lever configured to allow a boat operator to remotely control a forward drive mode, a neutral mode, and a reverse drive mode of the boat;

a boat propulsion unit comprising a shift switching device configured to selectively shift between the forward drive mode, the neutral mode, and the reverse drive mode, and a shift actuator configured to operate the shift switching device; and a control means for controlling the operation of the shift actuator in response to the operation amount of the remote control shift lever, when the remote control shift lever has been operated within a predetermined range of a shift range;

wherein the control means controls the shift actuator such that in the case where the remote control shift lever has been shifted between a neutral position and a forward position or reverse position, when an engine is stopped and when shifting is not completed within a certain period of time, the shift actuator stops shifting operation, and wherein the control means controls the shift actuator to produce smaller shifting forces when the engine is stopped and to produce larger shifting forces when the engine is in operation.

7. A boat comprising:

a remote control operation unit comprising a remote control shift lever configured to allow a boat operator to remotely control a forward drive mode, a neutral mode, and a reverse drive mode of the boat;

a boat propulsion unit comprising a shift switching device configured to selectively shift between the forward drive mode, the neutral mode, and the reverse drive mode, and a shift actuator configured to operate the shift switching device; and a control means for controlling the operation of the shift actuator in response to the operation amount of the remote control shift lever, when the remote control shift lever has been operated within a certain range of a shift range, wherein the control means controls the shift actuator such that in the case where the remote control shift lever has been shifted between a neutral position and a forward position or reverse position, when an engine is stopped and when shift speed is below a certain value after a lapse of a certain period of time from the start of shifting, the shift actuator stops shifting operation.

8. The boat according to claim 7 additionally comprising an alarm configured to be triggered when the control means stops the shifting operation.

9. The boat according to claim 7, wherein the control means controls the shift actuator to return to the neutral position after the stop of the shifting operation.

10. The boat according to claim 7, wherein the control means controls the shift actuator to return to a normal operating state when a target shift position has been set back to the neutral position through the operation of the shift lever after the stop of the shifting operation.

11. The boat according to claim 7, wherein the shifting is shift-out of the remote control shift lever from the forward position or the reverse position to the neutral position.

12. A boat comprising:

a remote control operation unit comprising a remote control shift lever configured to allow a boat operator to remotely control a forward drive mode, a neutral mode, and a reverse drive mode of the boat;

a boat propulsion unit comprising a shift switching device configured to selectively shift between the forward drive mode, the neutral mode, and the reverse drive mode, and a shift actuator configured to operate the shift switching device; and a control means for controlling the operation of the shift actuator in response to the operation amount of the remote control shift lever, when the remote control shift lever has been operated within a predetermined range of a shift range, wherein the control means controls the shift actuator such that in the case where the remote control shift lever has been shifted between a neutral position and a forward position or reverse position, when an engine is stopped and when shift speed is below a certain value after a lapse of a certain period of time from the start of shifting, the shift actuator stops shifting operation, and wherein the control means controls the shift actuator to produce smaller shifting forces when the engine is stopped and to produce larger shifting forces when the engine is in operation.

13. A boat comprising:

a remote control operation unit comprising a remote control shift lever configured to allow a boat operator to remotely control a forward drive mode, a neutral mode, and a reverse drive mode of the boat;

a boat propulsion unit comprising a shift switching device configured to selectively shift between the forward drive mode, the neutral mode, and the reverse drive mode, and a shift actuator configured to operate the shift switching device; and a control means for controlling the operation of the shift actuator in response to the operation amount of the remote control shift lever, when the remote control shift lever has been operated within a certain range of a shift range, wherein the control means controls the shift actuator such that in the case where the remote control shift lever has been shifted between a neutral position and a forward position or reverse position, when an engine is stopped and when the amount of electric current applied to the shift actuator is above a certain value for a certain period of time, the shift actuator stops shifting operation.

14. The boat according to claim 13 additionally comprising an alarm configured to be triggered when the control means stops the shifting operation.

15. The boat according to claim 13, wherein the control means controls the shift actuator to return to the neutral position after the stop of the shifting operation.

16. The boat according to claim 13, wherein the control means controls the shift actuator to return to a normal operating state when a target shift position has been set back to the neutral position through the operation of the shift lever after the stop of the shifting operation.

17. The boat according to claim 13, wherein the shifting is shift-out of the remote control shift lever from the forward position or the reverse position to the neutral position.

18. A boat comprising:

a remote control operation unit comprising a remote control shift lever configured to allow a boat operator to remotely control a forward drive mode, a neutral mode, and a reverse drive mode of the boat;

a boat propulsion unit comprising a shift switching device configured to selectively shift between the forward drive mode, the neutral mode, and the reverse drive mode, and a shift actuator configured to operate the shift switching device; and a control means for controlling the operation of the shift actuator in response to the operation amount of the remote control shift lever, when the remote control shift lever has been operated within a predetermined range of a shift range, wherein the control means controls the shift actuator such that in the case where the remote control shift lever has been shifted between a neutral position and a forward position or reverse position, when an engine is stopped and when the amount of electric current applied to the shift actuator is above a certain value for a certain period of time, the shift actuator stops shifting operation, wherein the control means controls the shift actuator to produce smaller shifting forces when the engine is stopped and to produce larger shifting forces when the engine is in operation.

19. A boat comprising:

a remote control operation unit comprising a remote control shift lever configured to allow a boat operator to remotely control a forward drive mode, a neutral mode, and a reverse drive mode of the boat;

a boat propulsion unit comprising a shift switching device configured to selectively shift between the forward drive mode, the neutral mode, and the reverse drive mode, and a shift actuator configured to operate the shift switching device; and a controller configured to control the operation of the shift actuator in response to the operation amount of the remote control shift lever, when the remote control shift lever has been operated within a predetermined range of a shift, range;

wherein the controller is configured to control the shift actuator to stop shifting operation when the remote control shift lever has been shifted between a neutral position and a forward position or reverse position, when an engine is stopped and at least one of (a) when shifting is not completed within a certain period of time, (b) when shift speed is below a certain value after a lapse of a certain period of time from the start of shifting, and (c) when the amount of electric current applied to the shift actuator is above a certain value for a certain period of time.

* * * * *

UNITED STATES PATENT AND TRADEMARK OFFICE

CERTIFICATE OF CORRECTION

PATENT NO. : 7,442,102 B2
APPLICATION NO. : 11/617508
DATED : October 28, 2008
INVENTOR(S) : Makoto Ito et al.

It is certified that error appears in the above-identified patent and that said Letters Patent is hereby corrected as shown below:

At item (56), page 2, column 2, line 21, under Other Publications, change "11/688,618" to --11/688,818--.

At item (56), page 2, column 2, line 30, under Other Publications, change "tachnology" to --technology--.

At column 10, line 60, in Claim 12, change "predetermined" to --certain--.

At column 12, line 7, in Claim 18, change "predetermined" to --certain--.

At column 12, line 15, in Claim 18, after "operation," insert --and--.

At column 12, line 35, in Claim 19, change "shift," to --shift--.

Signed and Sealed this

Fourth Day of May, 2010

David J. Kappos

David J. Kappos
*Director of the United States Patent and Trademark Office*